US007983727B2

(12) United States Patent
Nakanishi et al.

(10) Patent No.: US 7,983,727 B2
(45) Date of Patent: Jul. 19, 2011

(54) SUPERCONDUCTOR FILTER UNIT

(75) Inventors: Teru Nakanishi, Kawasaki (JP); Akihiko Akasegawa, Kawasaki (JP); Kazunori Yamanaka, Kawasaki (JP); Kazuaki Kurihara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 915 days.

(21) Appl. No.: 11/976,649

(22) Filed: Oct. 26, 2007

(65) Prior Publication Data

US 2008/0146450 A1 Jun. 19, 2008

(30) Foreign Application Priority Data

Dec. 15, 2006 (JP) ..... 2006-338938

(51) Int. Cl.
*H01B 12/02* (2006.01)
*H01P 1/20* (2006.01)

(52) U.S. Cl. ..... 505/210; 505/700; 505/701; 505/866; 333/99 S; 333/202

(58) Field of Classification Search ..... 505/210, 505/700, 706, 866; 333/99 S, 202, 204, 205
See application file for complete search history.

(56) References Cited

U.S. PATENT DOCUMENTS 5,484,764 A * 1/1996 Fiediuszko et al. ..... 505/210
5,589,020 A * 12/1996 Varghese ..... 156/185
6,873,864 B2 * 3/2005 Kai et al. ..... 505/210

FOREIGN PATENT DOCUMENTS

JP 2006-261122 * 9/2006
WO WO 00/52782 A1 9/2000

* cited by examiner

*Primary Examiner* — Stanley Silverman
*Assistant Examiner* — Kallambella Vijayakumar
(74) *Attorney, Agent, or Firm* — Fujitsu Patent Center

(57) ABSTRACT

In a wall of a package base made of aluminum or aluminum alloy, there is formed a through-hole, through which a semi-rigid coaxial cable passes. A central conductor of the semi-rigid coaxial cable is joined to an electrode with a solder material. The semi-rigid coaxial cable has an insulating material through which the central conductor passes and an outer conductor provided therearound. The central conductor and outer conductor are made of stainless steel, for example, and the insulating material is made of fluororesin, for example. Inside the through-hole, the wall of the package base and the outer conductor are electrically connected to each other via a stainless material within the hole formed in a cylindrical fluororesin material. The semi-rigid coaxial cable and the like are fixed to the wall with a conductive screw.

19 Claims, 6 Drawing Sheets

SUPERCONDUCTOR FILTER UNIT

CROSS-REFERENCE TO RELATED APPLICATIONS

This application is based upon and claims the benefit of priority from the prior Japanese Patent Application No. 2006-338938, filed on Dec. 15, 2006, the entire contents of which are incorporated herein by reference.

BACKGROUND OF THE INVENTION

1. Field of the Invention

The present invention relates to superconductor filter units used for a radio base station and the like.

2. Description of the Related Art

In recent years, with rapid development of radio communications, a high speed and large capacity transmission technology has become indispensable, and the expectations for a superconductor filter device using a high temperature superconductor are increasing. Superconductor has an extremely small surface resistance also in a high frequency region as compared with an ordinary electrically good conductor. This allows the transmission loss to be kept low even if the superconductor filter devices are multi-staged. Accordingly, the superconductor filter device allows excellent frequency cutoff characteristic to be obtained and allows frequency resources to be utilized effectively. However, in order to actually operate the superconductor filter device, the superconductor filter device needs to be cooled to ultra low temperature of the order of 70K. Namely, since the electric resistance of high temperature superconductor is high at room temperature, the superconductor filter device needs to be cooled. Then, in the conventional superconductor filter unit, a superconductor filter device and a cooler cooling the same are housed in a vacuum housing.

FIG. 10 is a view showing a conventional superconductor filter unit. In the conventional superconductor filter unit, on a package base 101 is disposed a superconductor filter device, which is covered with a lid 102. A metal package is composed of the package base 101 and the lid 102. A cooler 105 cooling the superconductor filter is provided under the package base 101 and these are housed in a vacuum housing 106. Moreover, on the exterior of the package base 101 is mounted a connector 107, to which is connected a semi-rigid coaxial cable 103 whose both ends are provided with connectors 104.

FIG. 11 is a view showing the interior of the conventional metal package. On the package base 101, a dielectric substrate 111 is provided via a grounding electrode and a superconductor film. On the dielectric substrate 111, a plurality of resonators 112 is arranged, the resonator being made of high temperatures superconductor and patterned in a hairpin shape. The resonators 112 is coupled to each other and thus constitutes a plane circuit type filter device. Moreover, the resonator 112 at the end is connected to a signal input/output line 131 via an electrode 114 and a solder material 115. This signal input/output line 131 is connected to the connector 107 for a coaxial cable. The input/output of a signal is performed via the signal input/output line 131 and the semi-rigid coaxial cable 103.

In such a superconductor filter unit, the frequency cutoff characteristic of the filter can be made abrupt by increasing the number of resonators 112, i.e., by multi-staging. Moreover, the plane circuit type filter is shielded from external high frequency signals by the package base 101 and the lid 102.

The superconductor filter unit is used in a radio base station and the like and is disposed, for example, directly under the antenna at the top of a steel tower of the base station, or the like. For this reason, in view of the transporting work and installation work, and the like, the superconductor filter unit is preferably miniaturized as much as possible. However, in the conventional superconductor filter unit, it is difficult to prevent the inflow of heat from the outside, and therefore the cooler 105 needs to be upsized to the extent to meet this need. Accordingly, the miniaturization of the superconductor filter unit itself has limitations.

Patent Document 1 (International Publication No. WO 00/52782) discloses a technique in which treatment is applied to the coaxial cable itself for the purpose of suppressing the inflow of heat via the coaxial cable. This technique may attain an intended purpose but may not satisfactorily miniaturize the superconductor filter unit.

SUMMARY OF THE INVENTION

An object of the present invention is to provide a superconductor filter unit that achieves drastic miniaturization.

The present inventors have come up with the following invention after continuing a devoted study to solve the above-described problem.

In a superconductor filter unit according to the present invention, there are provided a superconductor filter, a metal package housing the superconductor filter, a coaxial cable passing through a wall of the metal package, a central conductor of the coaxial cable being electrically connected to the superconductor filter. Further, in between an outer conductor of the coaxial cable and the metal package, there is provided a structure whose thermal conductivity under ultra low temperature environment is lower than that of stainless steel, the structure being electrically connectable. Here, the ultra low temperature environment refers to the environment below a temperature of 130K because the critical temperature (Tc) of material known as a high temperature superconductor is in the order of 130K.

DETAILED DESCRIPTION OF THE PREFERRED EMBODIMENTS

Hereinafter, embodiments of the present invention will be specifically described with reference to the accompanying drawings.

First Embodiment

Figure 1:
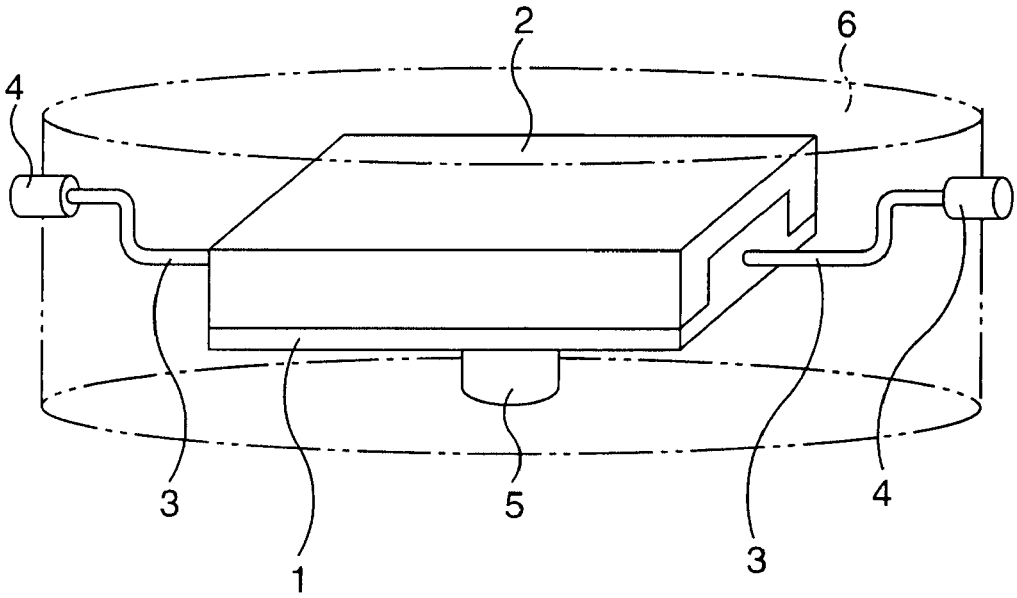
FIG. 1 is a perspective view showing a structure of a superconductor filter unit according to a first embodiment of the present invention.

First, a first embodiment of the present invention will be described. FIG. 1 is a perspective view showing a structure of a superconductor filter unit according to the first embodiment of the present invention.

In the first embodiment, on a package base 1 is disposed a superconductor filter device, which is covered with a metal lid 2. A metal package is composed of the package base 1 and the lid 2. The package base 1 and the lid 2 are made of aluminum or aluminum alloy, for example. Moreover, blade springs holding down the four corners of the superconductor filter device are fixed to the package base 1 with screws. A cooler 5 (cooling unit) cooling the superconductor filter via the metal package is provided under the package base 1, and these are housed in a vacuum housing 6. Furthermore, two walls are provided in the surface of the package base 1, and semi-rigid coaxial cables 3 pass through these walls respectively. A connector 4 making connection with the outside of a vacuum housing 6 is attached to the other end of the semi-rigid coaxial cable 3.

Figure 2:
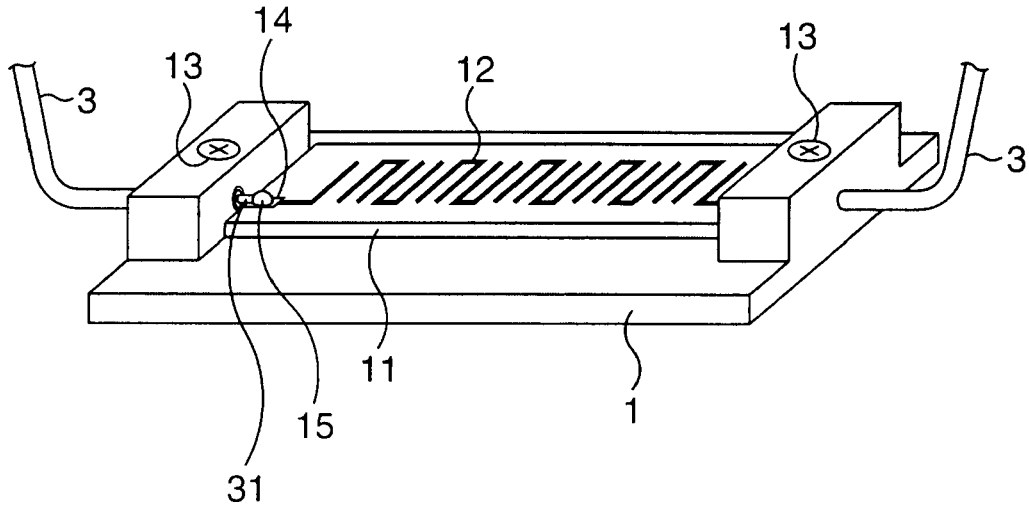
FIG. 2 is a view showing an interior of a metal package in the first embodiment.
Figure 3:
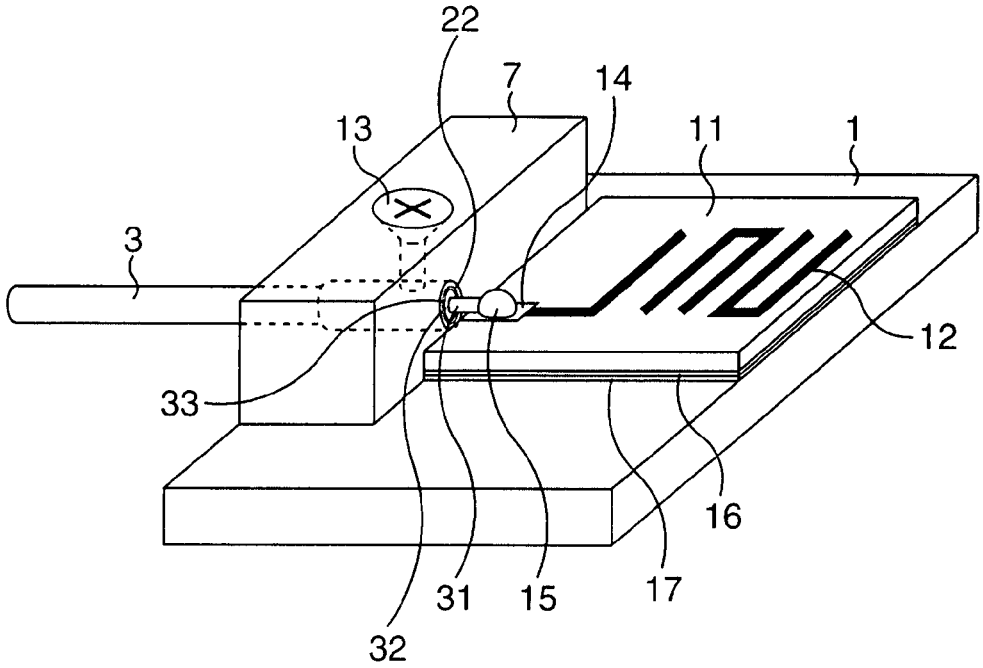
FIG. 3 is a perspective view showing an end of a semi-rigid coaxial cable 3 in the first embodiment.
Figure 4:
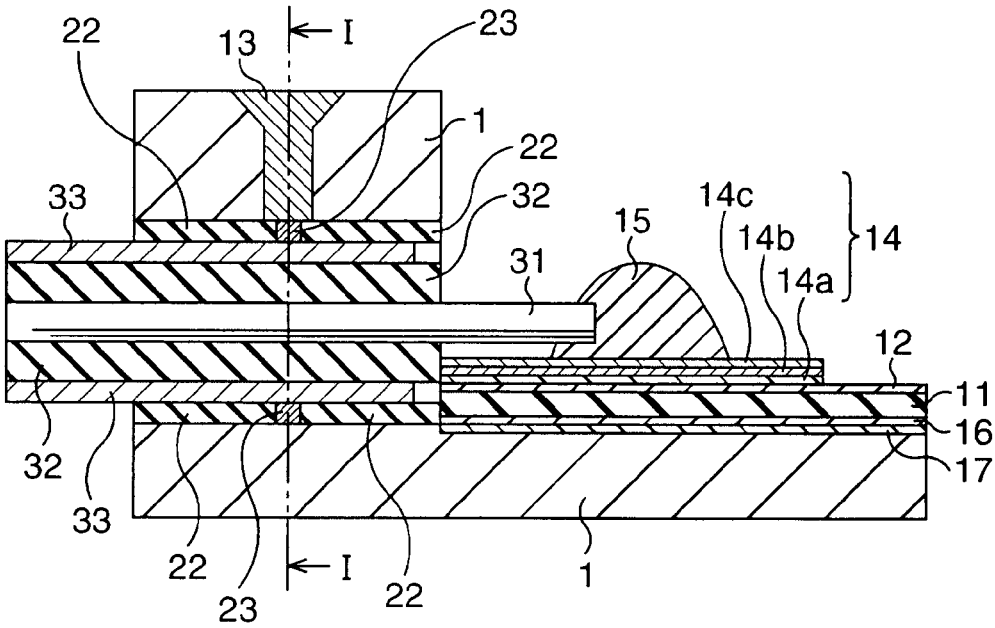
FIG. 4 is a cross sectional view showing the end of the semi-rigid coaxial cable 3 in the first embodiment.
Figure 5:
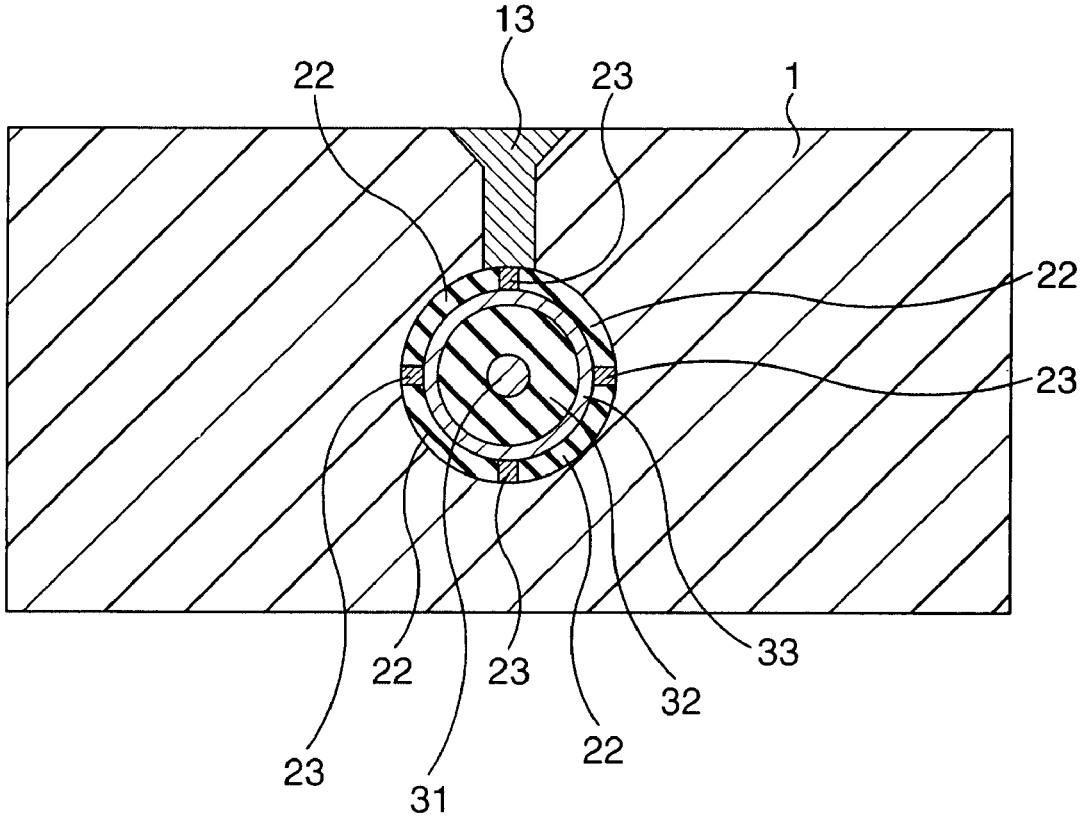
FIG. 5 is a cross sectional view showing the structure of the interior of a wall in the first embodiment.

Next, the interior of the metal package will be described. FIG. 2 is a view showing the interior of the metal package. FIG. 3 is a perspective view showing the end of the semi-rigid coaxial cable 3. FIG. 4 is a cross sectional view showing the end of the semi-rigid coaxial cable 3. FIG. 5 is a cross sectional view showing the structure of the interior of a wall and corresponds to the cross sectional view along the I-I line in FIG. 4.

On top of the package base 1, a dielectric substrate 11 is provided via a grounding electrode 17 and a superconducting film 16. The grounding electrode 17 is made of silver, for example, and the superconducting film 16 is made of an yttrium system oxide superconductor, such as $YBa_2Cu_3O_x$ (YBCO), for example. Further, the dielectric substrate 11 is made of single crystal magnesium oxide, for example. In addition, the package base 1 is grounded, and the superconducting film 16 is also grounded via the grounding electrode 17 and the package base 1. Further, a plurality of resonators 12 is arranged on the dielectric substrate 11, the resonator being patterned in a hairpin shape. The resonator 12 is formed of wiring of an yttrium system oxide superconductor, such as $YBa_2Cu_3O_x$ (YBCO), for example. The plurality of resonators 12 is coupled to each other and thus constitutes a plane circuit type filter. Moreover, an electrode 14 is formed on the resonator 12 at the end. The electrode 14 is formed, for example, by a Cr film 14*a*, a Pd film 14*b*, and a Ag film 14*c* being laminated in this order. The thickness of the Cr film 14*a* is 100 nm, for example, the thickness of the Pd film 14*b* is 200 nm, for example, and the thickness of the Ag film 14*c* is 100 nm, for example.

Moreover, in the walls of the package base 1 are formed through-holes through which the semi-rigid coaxial cables 3 pass. A central conductor 31 of the semi-rigid coaxial cable 3 is joined to the electrode 14 with a solder material 15. The solder material 15 is made of indium-based solder, for example. Moreover, in the semi-rigid coaxial cable 3 is provided an insulating material 32 through which the central conductor 31 passes, and an outer conductor 33 is provided therearound. The central conductor 31 and outer conductor 33 are made of stainless steel, for example, and the insulating material 32 is made of fluororesin, for example.

Moreover, a structure is disposed in between the outer conductor 33 and the wall of the package base 1, which the structure is composed of a cylindrical fluororesin material 22 having a plurality of holes formed therein and stainless materials 23 buried in the holes. Further, with a conductive screw 13 (fixing member), the structure and the semi-rigid coaxial cable 3 are fixed to the wall. Moreover, the outer conductor 33 and the wall of the package base 1 are electrically connected to each other via the stainless material 23.

The average thermal conductivity of the fluororesin material 22 from room temperature to approximately 76K is about 0.25 W/m·K, for example. For this reason, even if heat flows in from the outside of the vacuum housing 6 via the semi-rigid coaxial cable 3, this heat is unlikely to transmit to the metal package (package base 1 and lid 2). Accordingly, the metal package and the superconductor filter can be cooled sufficiently without upsizing the cooler 5, thus allowing the superconductor filter unit to be miniaturized.

Moreover, since the semi-rigid coaxial cable 3 passes through the wall and the central conductor 31 is directly joined to the electrode 14, a connector between the semi-rigid coaxial cable 3 and the wall is not required. The superconductor filter unit can be miniaturized also from this point.

In this way, according to this embodiment, the miniaturization of the cooler 5 and the reduction of the number of components allow the superconductor filter unit to be miniaturized drastically.

For example, as compared with a conventional general superconductor filter unit (the diameter of the vacuum housing is approximately 100 mm), the elimination of the connector allows the size in the diameter direction of the vacuum housing to be reduced by approximately 30 mm and allows the capacity of the vacuum housing to be reduced by as large as approximately 50%.

In addition, the conductive material to be buried into the hole is not limited to a stainless material, and even if the one made of metal, such as cupro nickel, having the thermal conductivity equivalent to that of stainless steel is used, an equivalent effect can be obtained. Moreover, even with a conductive material of high heat conductivity, if the area of contact with the outer conductor 33 and the package base 1 is reduced, an equivalent effect can be obtained. Moreover, as a structure disposed between the outer conductor 33 and the wall of the package base 1, a conductive material, such as foam metal, whose thermal conductivity under ultra low temperature environment is lower than that of stainless steel may be used. Furthermore, since the thermal conductivity of SUS304, which is a type of stainless, under ultra low temperature environment (environment of less than or equal to approximately 130K) is 11.24 W/m·K, the thermal conductivity of the structure as a whole is preferably less than 11.24 W/m·K.

Figure 6:
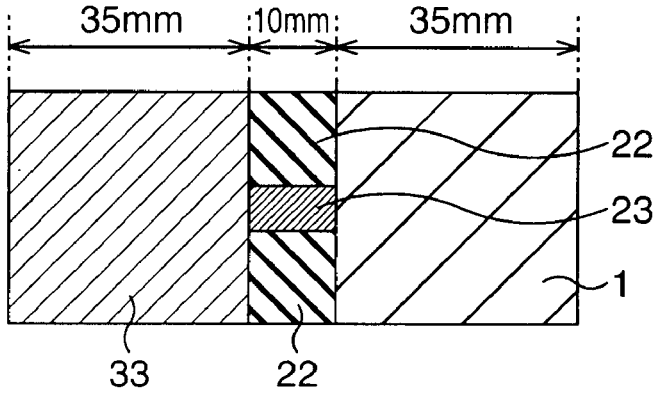
FIG. 6 is a view showing a model used in a simulation relating to the first embodiment.

Here, the contents and results of a simulation the present inventors actually carried out-will be described. FIG. 6 is a view showing a model used in the simulation relating to the first embodiment. In this simulation, the model was used in which the fluororesin material 22 with the thickness of 10 mm is interposed between the outer conductor 33 with the thickness of 35 mm and the package base 1 with the thickness of 35 mm. It was assumed that the fluororesin material 22 had rectangular holes formed therein and in the interior thereof the stainless material 23 was buried, and further the width of the hole (stainless material 23) was approximately 7% of the width of the fluororesin material 22. Moreover, it was assumed that the outer conductor 33 and the stainless material 23 were made of stainless steel whose average thermal conductivity from room temperature to 76K was 11.24 W/m·K and the average thermal conductivity of the fluororesin material 22 from room temperature to 76K was 0.25 W/m·K, and that the package base 1 was made of aluminum.

Then, the temperature of the outer conductor 33 was fixed to 300K, and the temperature of the package base 1 was calculated when a predetermined time had elapsed. It was assumed that the temperature of the fluororesin material 22, stainless material 23, and package base 1 at the initial state was 70K. As a result, the temperature of the package base 1 when a predetermined time had elapsed was approximately 70.2K.

For comparison, when a simulation (comparison example) was carried out where the structure composed of the cylindrical fluororesin material 22 having a plurality of holes formed therein, and the stainless material 23 buried in the hole was replaced with the stainless material whose average thermal conductivity from room temperature to 76K was 11.24 W/m·K, the temperature of the package base 1 when the same predetermined time had elapsed was 73.3K.

In this way, the presence or absence of the fluororesin material 22 made a difference as large as 3K. 3K is an extremely large temperature difference considering the cooling capability of a small-size cooler, and thus the effect of the miniaturization of the cooler due to the first embodiment may be extremely excellent.

Second Embodiment

Figure 7:
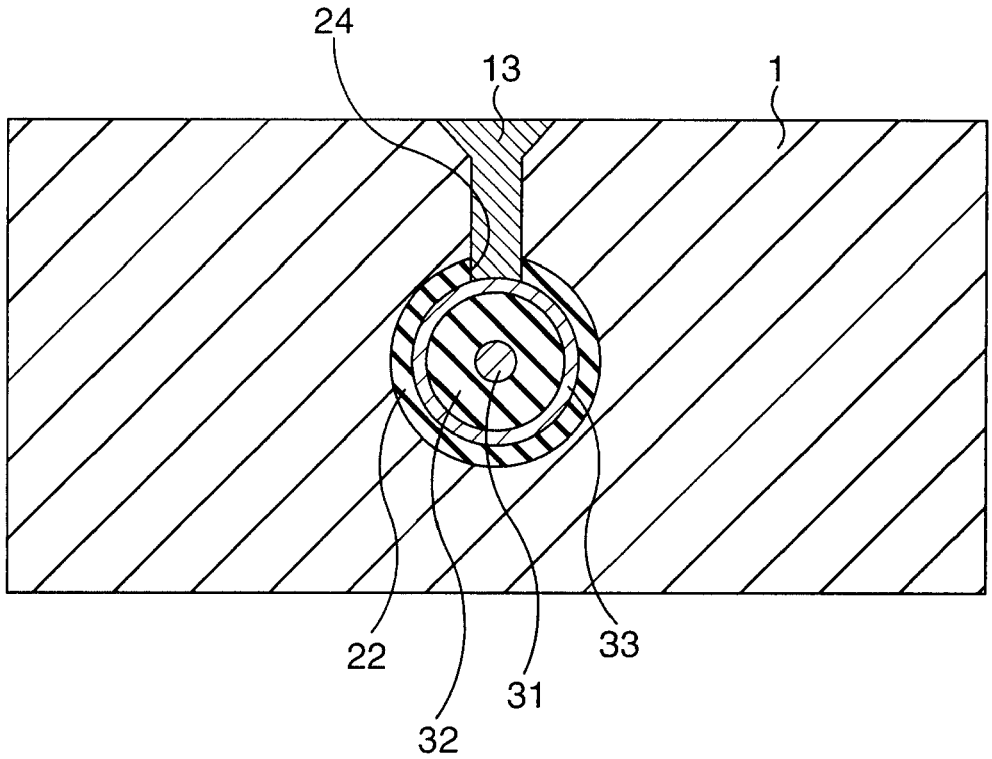
FIG. 7 is the cross sectional view showing a structure of an interior of a wall in a superconductor filter unit according to a second embodiment of the present invention.

Next, a second embodiment of the present invention will be described. FIG. 7 is a cross sectional view showing the structure of the interior of a wall in a superconductor filter unit according to the second embodiment of the present invention.

In the second embodiment, an opening 24 is formed only in a portion corresponding to a screw 13 of a cylindrical fluororesin material 22, and a hole into which a stainless material 23 is buried is not formed. A screw 13 is in contact with an outer conductor 33 via the opening 24. Other configuration is the same as that of the first embodiment.

Also with such second embodiment, the thermal conductivity of the fluororesin material 22 is significantly lower than that of the stainless forming the outer conductor 33, so the load on the cooler 5 can be reduced as with the first embodiment. Accordingly, the superconductor filter unit can be miniaturized drastically.

In addition, in the second embodiment, the outer conductor 33 and the wall of the package base 1 are electrically connected to each other via the conductive screw 13.

Third Embodiment

Figure 8:
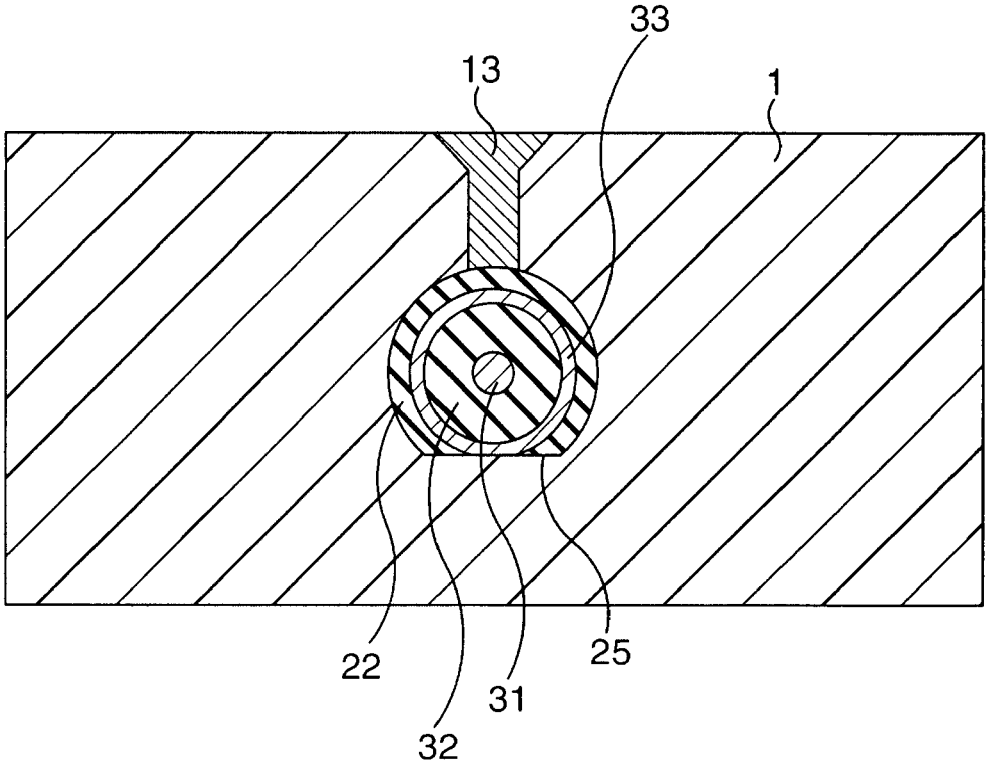
FIG. 8 is the cross sectional view showing a structure of an interior of a wall in a superconductor filter unit according to a third embodiment of the present invention.

Next, a third embodiment of the present invention will be described. FIG. 8 is a cross sectional view showing the structure of the interior of a wall in a superconductor filter unit according to the third embodiment of the present invention.

In the third embodiment, a part of a cylindrical fluororesin material 22 is cut off flat to form a flat part 25, and an outer conductor 33 and a wall of a package base 1 are in contact with each other via the center of the flat part 25. Other configuration is the same as that of the first embodiment.

Also with such third embodiment, the thermal conductivity of the fluororesin material 22 is significantly lower than that of stainless forming the outer conductor 33, so the load on a cooler 5 can be reduced as with the first embodiment. Accordingly, the superconductor filter unit can be miniaturized drastically.

Fourth Embodiment

Figure 9:
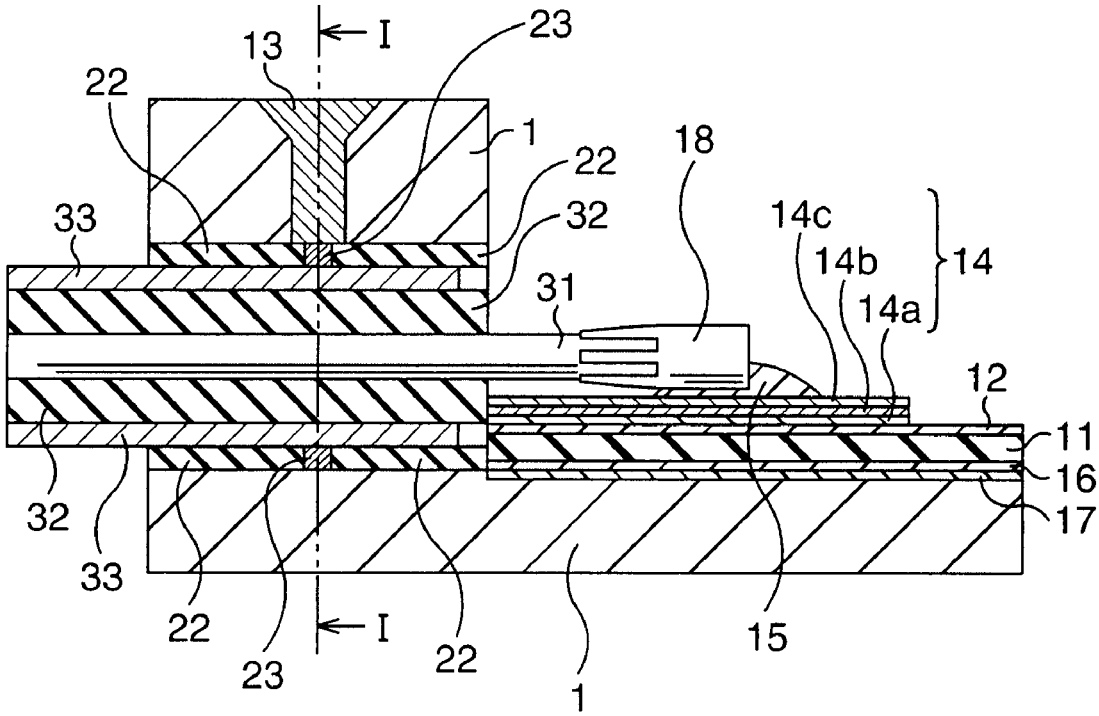
FIG. 9 is a cross sectional view showing an end of a semi-rigid coaxial cable 3 in a superconductor filter unit according to a fourth embodiment of the present invention.
Figure 10:
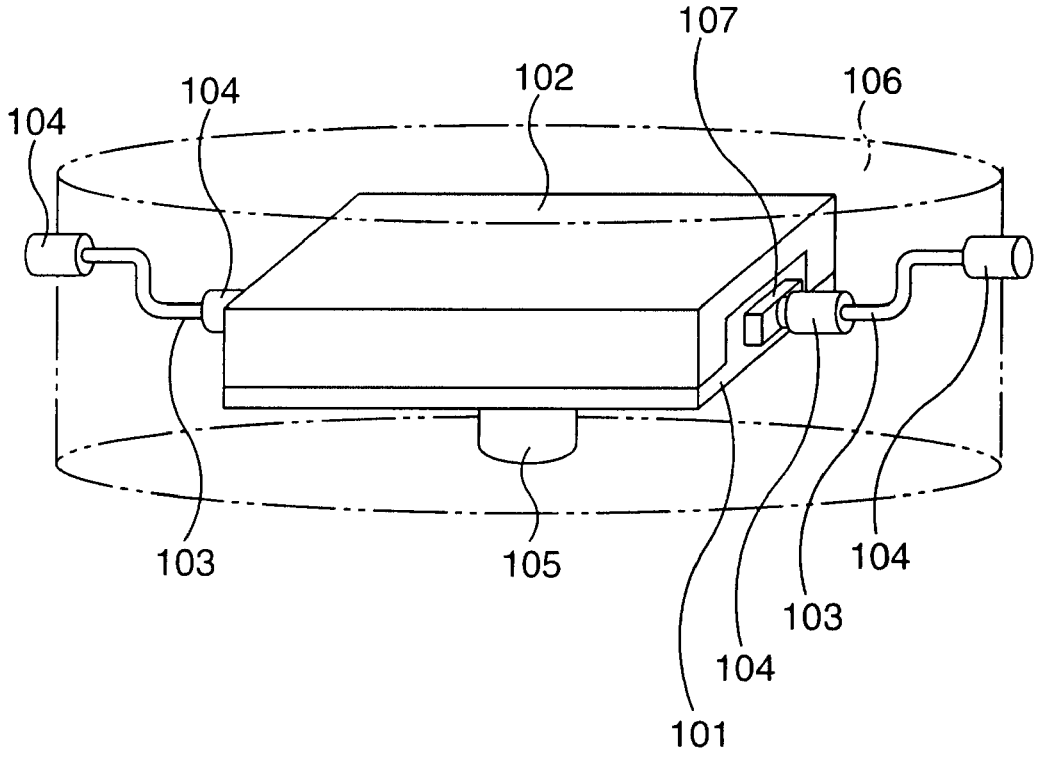
FIG. 10 PRIOR ART
FIG. 10 is a view showing a conventional superconductor filter unit.
Figure 11:
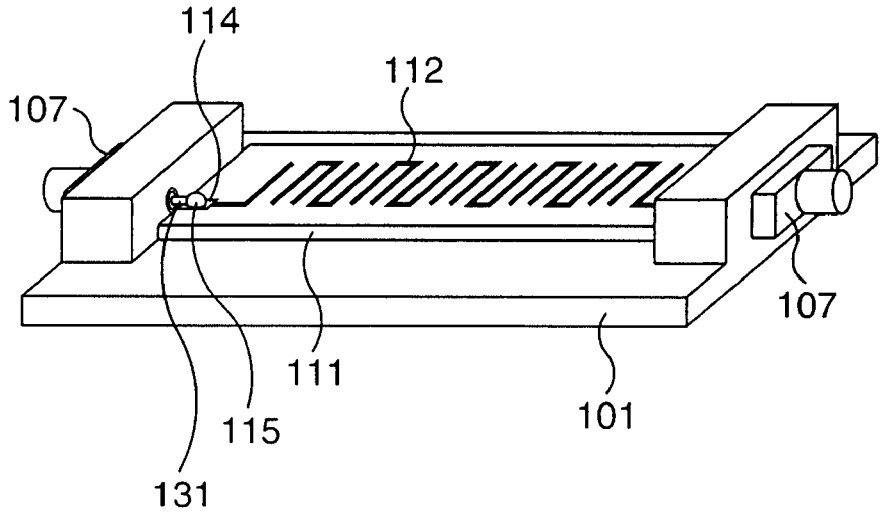
FIG. 11 PRIOR ART
FIG. 11 is a view showing an interior of a conventional metal package.

Next, a fourth embodiment of the present invention will be described. FIG. 9 is a cross sectional view showing the end of a semi-rigid coaxial cable 3 in a superconductor filter unit according to the fourth embodiment of the present invention.

In the fourth embodiment, a conductive insert part 18 is joined to an electrode 14 with a solder material 15. The insert part 18 is provided with an opening that faces to the wall of the package base 1, and a slit is formed at multiple places on the side thereof. A central conductor 31 of a semi-rigid coaxial cable 3 is inserted into the opening of the insert part 18. The central conductor 31 is elastically fixed by the insert part 18. Other configuration is the same as that of the first embodiment.

Also with the fourth embodiment, the same effect as that of the first embodiment is obtained. Moreover, in the fourth embodiment the central conductor 31 can be easily removed from the insert part 18, so that the semi-rigid coaxial cable 3 can be exchanged easily. Namely, at the time of exchanging the semi-rigid coaxial cable 3, the removal of the screw 13, removal of the semi-rigid coaxial cable 3, insertion of new semi-rigid coaxial cable 3, and attachment of the screw 13 just need to be carried out and thus the heat treatment to the solder material 15 is not required.

In addition, in place of the fluororesin material, epoxy resin material, acrylic resin material, polycarbonate material, glass material, ceramic material, or foamed resin material may be used. Note that, since the thermal conductivity of most of insulating material is lower than that of stainless, the object of the present invention can be attained, however, the one which will not stiffen under temperature conditions of the order of 70K is preferably used.

Further, connection between the central conductor and the electrode may be made via a bonding wire or a bonding tape.

Moreover, the material of the resonator that forms the superconductor filter is not limited in particular, and for example, R—Ba—Cu—O (R is one type selected from a group consisting of Y, Nd, Yb, Sm, or Ho) system superconductor, Bi—Sr—Ca—Cu—O system superconductor, Pb—Bi—Sr—Ca—Cu—O system superconductor, or $CuBa_pCa_qCu_rO_x$ ($1.5<p<2.5$, $2.5<q<3.5$, $3.5<r<4.5$) system superconductor can be used.

In addition, although in the above-described embodiments each, the structure exists between the metal package and the outer conductor 33, this portion may be made a space without interposing the structure therebetween.

According to the present invention, a connector connecting the metal package and the coaxial cable can be eliminated because the coaxial cable passes through the wall of the metal package and reaches the interior thereof. Moreover, the inflow of heat from the outside is suppressed because the thermal conductivity between the outer conductor of the coaxial cable and the metal package is lower than that of stainless. Accordingly, a cooling unit cooling the superconductor filter does not need to be a large-scale one. Then, as a synergistic effect of these, the superconductor filter unit can be miniaturized drastically.

What is claimed is:

1. A superconductor filter unit, comprising:

a superconductor filter;

a metal package housing said superconductor filter, said metal package including a wall with a through-hole;

a coaxial cable including a central conductor, an insulating material, and an outer conductor, said central conductor, said insulating material, and said outer conductor passing through said through-hole, and said central conductor being electrically connected to said superconductor filter; and a structure provided between said outer conductor and an inner surface of said through-hole in said through-hole, thermal conductivity of said structure under ultra low temperature environment being lower than that of stainless steel, and said structure capable of being electrically connected.

2. The superconductor filter unit according to claim 1, wherein a conductive material is provided as said structure.

3. The superconductor filter unit according to claim 2, wherein said conductive material is foam metal material.

4. The superconductor filter unit according to claim 1, wherein said structure includes:

an insulating material; and a conductive material passing through said insulating material and electrically connecting said outer conductor and said metal package to each other.

5. The superconductor filter unit according to claim 1, wherein said structure includes an insulating material formed with an opening therein, said superconductor filter unit further comprises a conductive fixing member contacting said outer conductor through said opening and fixing said coaxial cable to said metal package, and the fixing member also contacts said metal package.

6. The superconductor filter unit according to claim 1, wherein said structure includes an insulating material provided with an opening in a part thereof, said opening connecting an outside thereof with an inside thereof, and said outer conductor directly contacts said metal package through said opening.

7. The superconductor filter unit according to claim 4, wherein said insulating material is one selected from a group consisting of fluororesin material, epoxy resin material, acrylic resin material, polycarbonate material, glass material, and ceramic material.

8. The superconductor filter unit according to claim 5, wherein said insulating material is one selected from a group consisting of fluororesin material, epoxy resin material, acrylic resin material, polycarbonate material, glass material, and ceramic material.

9. The superconductor filter unit according to claim 6, wherein said insulating material is one selected from a group consisting of fluororesin material, epoxy resin material, acrylic resin material, polycarbonate material, glass material, and ceramic material.

10. The superconductor filter unit according to claim 4, wherein said insulating material is a foam resin material.

11. The superconductor filter unit according to claim 5, wherein said insulating material is a foam resin material.

12. The superconductor filter unit according to claim 6, wherein said insulating material is a foam resin material.

13. The superconductor filter unit according to claim 1, further comprising an electrode connected to said superconductor filter, wherein said central conductor is joined to said electrode with a solder material.

14. The superconductor filter unit according to claim 1, further comprising:

an electrode connected to said superconductor filter; and a conductive insert part joined to said electrode with a solder material, wherein said central conductor is inserted into said insert part.

15. The superconductor filter unit according to claim 1, further comprising an electrode connected to said superconductor filter, wherein said central conductor is joined to said electrode via a bonding wire or a bonding tape.

16. The superconductor filter unit according to claim 1, wherein said superconductor filter includes a resonator containing one of superconductor selected from a group consisting of R—Ba—Cu—O (R is one selected from a group consisting of Y, Nd, Yb, Sm, and Ho) system superconductor, Bi—Sr—Ca—Cu—O system superconductor, Pb—Bi—Sr—Ca—Cu—O system superconductor, and $CuBa_pCa_qCu_rO_x$ ($1.5<p<2.5$, $2.5<q<3.5$, $3.5<r<4.5$) system superconductor.

17. The superconductor filter unit according to claim 1, wherein said superconductor filter is a plane circuit type.

18. The superconductor filter unit according to claim 1, further comprising a cooler cooling said superconductor filter via said metal package.

19. The superconductor filter unit according to claim 1, wherein said metal package is grounded.

* * * * *